United States Patent [19]

Vieux et al.

[11] Patent Number: 4,960,608

[45] Date of Patent: Oct. 2, 1990

[54] MANUFACTURING PROCESS OF A PHOTOCATHODE FOR AN IMAGE INTENSIFIER TUBE

[75] Inventors: Gerard Vieux, Grenoble; Daniel Boisson, Le Grand Lemps; Paul de Groot, St Ismier; Gilbert-René Colomb, Voiron, all of France

[73] Assignee: Thomson-CSF, Paris, France

[21] Appl. No.: 296,128

[22] Filed: Jan. 12, 1989

[30] Foreign Application Priority Data

Jan. 15, 1988 [FR] France ..... 88 00411

[51] Int. Cl.[5] ..... B05D 5/12

[52] U.S. Cl. ..... 427/10; 427/74; 427/75; 427/160; 427/237; 427/238

[58] Field of Search ..... 427/10, 74, 166, 75, 427/238, 237, 160

[56] References Cited

U.S. PATENT DOCUMENTS 2,676,282 4/1954 Polkosky ..... 313/541

4,305,972 12/1981 McDonie ..... 427/10

4,525,376 6/1985 Edgerton ..... 427/10

*Primary Examiner*—Janyce Bell

*Attorney, Agent, or Firm*—Oblon, Spivak, McClelland, Maier & Neustadt

[57] ABSTRACT

The invention concerns a manufacturing process of a photocathode for an image intensifier tube.

According to this process, the photocathode is made within the tube by depositing a photoelectric material on a conductive substrate by vacuum evaporation. During this operation, the optical transparency of the deposit is checked by illumination of this deposit by a light source. According to the invention, this light source is located within the tube and is protected from the vapors of the photoelectric material. In the prior art, this light source was located outside the tube and the illumination of the deposit was not sufficient.

The invention has applications in the field of image intensifier tubes.

13 Claims, 1 Drawing Sheet

MANUFACTURING PROCESS OF A PHOTOCATHODE FOR AN IMAGE INTENSIFIER TUBE

BACKGROUND OF THE INVENTION

1. Field of the Invention

The invention concerns the manufacturing process of a photocathode for a luminous or X-ray image intensifier tube.

These tubes are used in radiology or for the study of luminous phenomena. In the case of radiology, these tubes are combined with scintillators which convert incident X photons into light photons.

Image intensifier tubes consist of a vacuum enclosure usually made of glass in which are located an input screen, an output screen, a photocathode near the input screen, an anode near the output screen, and a system of electron optics comprising electrodes which accelerate and focus the electrons, said electrodes being located between the photocathode and the anode. In the case of X-ray image intensifier tubes, the input screen comprises a scintillator which converts the incident X photons into visible photons. In the case of luminous image intensifier tubes, the input screen receives the incident photons directly.

The visible photons strike the photocathode, which is generally made of a conductive substrate coated with a photoelectric deposit; the photocathode then generates a flow of electrons which are transmitted by the intermediate electrodes to an anode which focuses them. These focused electrons are directed towards the observation screen, consisting of a luminophore which emits visible light. This light can afterwards be transmitted to a camera or a film camera to be processed and analyzed.

The most frequently used photocathodes consist of a deposit of alkaline antimonide which can have one of the following chemical compositions: $SbCS_3$, $SbK_3$ $SbK_2CS$, SbKNaCS, SbKRbCs. This composition contains antimony and one or more alkaline metals.

These photocathodes can be obtained by depositing alternate layers of antimony and alkaline metals on a substrate until the necessary level of sensitivity is achieved. For example, the following layered structure Sb K, Sb, K, Sb, . . . can be deposited.

The photocathodes can also be obtained by depositing simultaneously antimony and alkaline metals on the substrate.

A manufacturing process of photocathodes knwon in prior art consists in placing a antimony generator and a number of alkaline generators, one for each of the alkaline metals of the chemical composition, inside the vacuum enclosure of a luminous or X-ray image intensifier tube. The photocathode must be manufactured in the tube vacuum enclosure since alkaline metals are highly reactive and must be generated under vacuum to remain stable.

The antimony generator comprises a crucible containing antimony which is then evaporated by heating the crucible, for example by a Joule effect.

Each alkaline generator includes a crucible containing an alkaline metal chromate and aluminium or silicon. The heating of the generator, usually by a Joule effect, produces aluminothermics or silicothermics of the compound and liberates the alkaline metal and reaction products.

FIG. 1 is a schematic drawing of an X-ray image intensifier tube which gives a clear idea of the manufacturing process of the photocathode according to a method known in prior art. This tube includes a vacuum enclosure 1 and a scintillator 2 which is part of the input screen. Usually, the photocathode is not deposited directly on the scintillator but on an electrically conductive underlayer 3 which can reconstitute the charges of the photocathode material. This underlayer can for example be made of alumina or of indium oxide or a mixture of these two substances. The system of electron optics of the X-ray image intensifier tube comprises several electrodes referenced G1, G2 and G3 and an anode A. The observation screen of the tube is referenced 4.

The antimony generator 5 and the alkaline generator 6 used in this embodiment are represented in the vacuum enclosure 1. In this embodiment, chosen as an example, the alkaline generator 6 is supported by the grid G3. The antimony generator 5 is placed in the electron path and must therefore be removed from the vacuum enclosure when the photocathode is finished. Said generator can be supported on a removable device including for example a rail 9 sliding on a guide 10 in a lateral appendix 11 of the vacuum enclosure 1. When the photocathode is finished, the rail 9 and the antimony generator 5 are removed with the appendix 11 which is then separated from the vacuum enclosure by melting and sealing the appendix 11 near its junction with said enclosure.

The antimony generator 5 comprises a crucible containing anitomy which is evaporated by heating said crucible, for example by a Joule effect.

The alkaline generator 6 comprises a crucible which is then heated, for example by a Joule effect, to evaporate its contents.

During the manufacturing process, the photocathode must be permanently exposed to light. The photoelectricity generated by the photocathode, i.e., the photoelectric current it produces when it is illuminated, varies during the manufacturing process. This variation is linked to the quantity of antimony and alkaline metal which is gradually deposited on the substrate. The measurement of the photoelectric current thus allows to check the transparency of the photocathode and to determine the proportions of the different constituents of the deposit which forms said photocathode.

With reference to FIG. 1 representing the prior art, the manufacturing process of the photocathode 7 includes the following steps.

During the deposit of a first layer of an alkaline metal, for example cesium or potassium, a photoelectric current is produced in the layer by the illumination 8 generated by a lamp 12 placed outside the vacuum enclosure 1 in front of the layer being made. The photoelectric current is measured with a intensity measuring instrument 13 which is connected, for example, to the conductive underlayer 3 and to the anode A. This current measurement is used to estimate the transparency of the deposit during the manufacturing process. Insulating, vacuum-tight feedthroughs 14 and 15 for connecting the intensity measuring instrument 13 are of course provided in the walls of the vacuum enclosure 1. When the photoelectric current produced by the illumination of the first layer reaches a predetermined value, the deposit of said layer is then stopped.

A second layer of antimony is then deposited, and the measured value of the photoelectric current decreases. When a certain limit is reached, the antimony deposit is stopped. Alternating layers of alkaline metals and antimony are then deposited. The measured value of the photoelectric current increases and decreases during these alternating deposits, as explained above. When the photoelectric current reaches a predetermined maximum value, the manufacturing process is ended.

FIG. 2 is a diagram showing the variations of the intensity I of the photoelectric current versus time during the manufacturing process of the photocathode.

If the process is chosen in which all of the antimony is deposited at once, the thickness of the different alkaline metal layers can be checked by measuring successive threshold values of the photoelectric current. These current measurements give an estimation of the transparency of the photocathode.

The lamp 12, when placed outside the tube vacuum enclosure 1, at the base of said tube, does not illuminate the photocathode sufficiently, even if the vacuum enclosure is a glass enclosure, as is the case with X-ray image intensifier tubes. Illumination problems are even more complex if the vacuum enclosure is a metal enclosure, in which case a transparent window must then be opened in the enclosure to allow illumination of the photocathode. If such a window cannot be provided, illumination cannot take place and the process of making the photocathode then becomes very different to control. The measurement of the photoelectric current performed directly on the substrate is not very accurate.

The object of the invention is to find a solution for these drawbacks and, more particularly, to make a photocathode by measuring the values of the photoelectric current generated during the manufacturing process, the photocathode being illuminated by a light source placed within the vacuum enclosure so as to avoid any attenuation of light by the enclosure walls, even in cases when the illumination of the photocathode from outside would be impossible because the enclosure is entirely opaque. Furthermore, the process according to the invention allows a much more accurate measurement of the photoelectric current during the manufacturing process.

The invention therefore concerns a manufacturing process of a photocathode for an image intensifier tube, said tube comprising a vacuum enclosure containing the photocathode, an anode, and one or several electrodes located between said anode and the photocathode; said process consisting in depositing a photoelectric material on a conductive substrate by vacuum evaporation of said photoelectric material, and, during the evaporation, in checking the optical transparency of the deposit by illumination of said deposit with a light source, said light source being located within the tube and protected from the vapours of said photoelectric material.

According to an embodiment of the ivention process, the optical transparency of the deposit is checked with an instrument measuring the photoelectric conduction of said deposit, said instrument being electrically connected to the substrate and placed outside the tube.

According to another embodiment of the process, the optical transparency of the deposit is checked by a measuring instrument connected to internal photoelectric devices, said devices being sensitive to the thickness of said deposit.

According to another embodiment, sensitive photoelectric devices consist of a photodiode located near said substrate beyond the electro path, said photodiode and the substrate being coated simultaneously by said deposit during the vacuum evaporation of said material. In this particular case, the attenuation of the signal emitted by the illuminated photodiode, which is due to the opacification of said photodiode by the photocathode deposit, is carefully measured. This measurement thus gives an estimation of the optical transparency of the photocathode.

According to another embodiment of the process, the light source is protected by one of the electrodes.

According to another embodiment, the light source is supported by one of the electrodes and is located beyond the path of the electrons emitted by the photocathode.

According to another embodiment of the process, the light source is connected to an external electric power supply by connecting wires which are fed through the tube walls in insulating wire feedthroughs.

According to another embodiment, the light source is activated by an external high-frequency generator.

According to another embodiment, the light source is removed from the vacuum enclosure at the end of the manufacturing process.

According to another embodiment, said photoelectric material is an alkaline antimonide.

According to a particular embodiment, the alkaline antimonide is obtained by vacuum evaporation of the antimony and of the alkaline metals contained in crucibles which are heated within the vacuum enclosure.

According to a particular embodiment, the light source is mounted on a removable system and is removed from the vacuum enclosure at the end of the manufacturing process.

According to another embodiment, one at least of the crucibles is mounted on a removable system and is removed from the vacuum enclosure at the end of the manufacturing process.

BRIEF DESCRIPTION OF THE DRAWINGS

Other specific features and advantages of the invention will appear more clearly from the following detailed description, made with reference to the appended drawings, of which.

On FIG. 1 and FIG. 3, the same parts have the same references.

Figure 3:
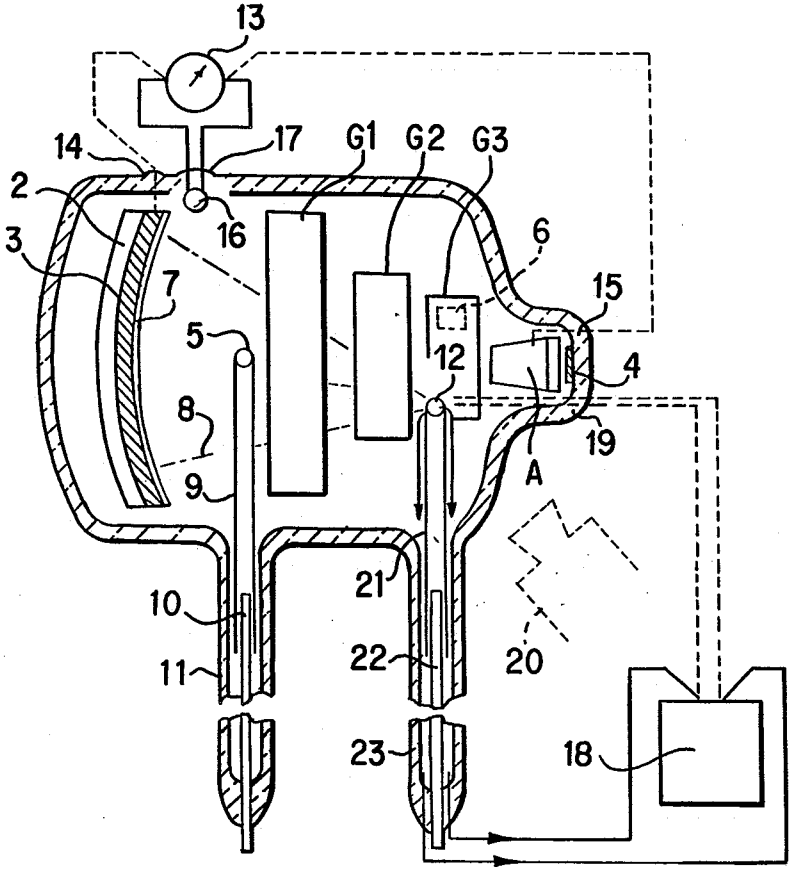
FIG. 3 is a schematic drawing of an X-ray image intensifier tube during the manufacturing process according to the invention process.
Figure 2:
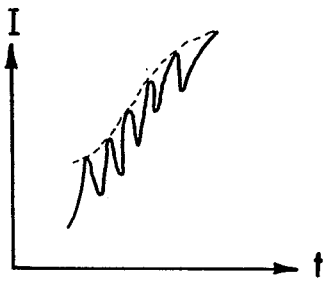
Figure 1:
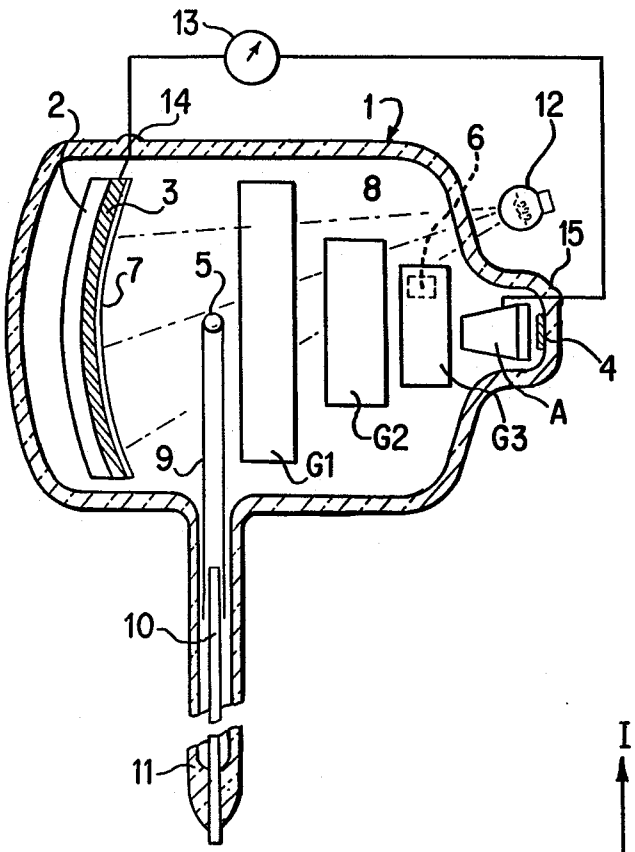
FIG. 1 has already been described and shows a schematic drawing of an X-ray image intensifier tube as known in prior art during the manufacturing process according to a method known in prior art, FIG. 2 has already been described and shows a diagram of the variation of the value of the intensity of the photoelectric current produced by the illuminated photocathode during the manufacturing process.

The invention process concerns the making of a photocathode 7 for luminous or X-ray image intensifier tubes, as shown by the schematic drawing on FIG. 3; the vacuum enclosure of these tubes is represented on FIG. 1. In the embodiment of this figure, given as an example, it is supposed that the tube is an X-ray image intensifier tube and that it includes a photocathode formed on the conductive substrate 3 and a scintillator 2. This tube also includes an anode A and, between the photocathode 7 and the anode A, a system of electron optics comprising the electrodes G1, G2 and G3. An output screen 4 is also represented on this figure behind the anode A. The process known in prior art consists in depositing by vacuum evaporation a photoelectric material such as an alkaline antimonide on the conductive substrate 3. As in the prior art, the antimony generator 5 is a crucible heated by a Joule effect, whereas the alkaline metals generator is a crucible 6, equally heated by a Joule effect. The antimony generator 5 can be fixed on a rail 9 sliding on a guide rod 10 located in the appendix 11, so that the generator can be removed at the end of the manufacturing process. As in the prior art, the photoelectric conduction of the photoemissive deposit is also measured through exposing the deposit to a light source.

According to the invention, this light source 12 is placed within the tube vacuum enclosure 1 so as to obtain a direct illumination 8 of the deposit without any attenuation of the light. To protect the light source 12 from the vapours of the photoelectric material, it is placed near one of the electrodes, for example G3, on the side of one of the faces of this electrode, whereas the generator 6 is located near the other face of this electrode. The generator 5 is located near the electrode G1. The result is that the light source 12, which can for example be an electric lamp, is "shadowed" by the G3 electrode and thus protected against the vapours produced by the generators.

The optical transparency of the deposit is checked by measuring the photoelectric conduction of this deposit 7 when illuminated by the light source 12 with a power measuring instrument 13 placed outside the vacuum enclosure 1 and which is connected to the substrate 3 and to the anode A. The transparency of the deposit can also be checked with this measuring instrument 13 by connecting said instrument to internal photoelectric devices such as a photodiode 16. During the deposit of the photoelectric material on the substrate, said material is also deposited on the photodiode. The thickness of the material is identical on the substrate and on the photodiode. The measurement of the photodiode transparency is then equivalent to the measurement of the deposit transparency, but it is also much more accurate. The conductive wires which connect the measuring instrument 13 to the substrate 3 or to the photodiode 16 penetrate inside the tube by means of insulating wire feedthroughs 14 and 17. The photodiode 16 is located near the substrate 3, preferably near the periphery of the substrate, beyond the path of the electrons which are emitted by the photocathode under normal operating conditions of the tube at the end of the manufacturing process. The photodiode could be left inside the tube so as not to complicate the manufacturing process.

The light source 12 which is protected against the projections of the photoelectric material by the G3 electrode can also be supported by this electrode. In this case, this light source can be located beyond the path of the electrons emitted by the photocathode and arriving at the anode, and can be left inside the tube at the end of the manufacturing process. This light source can be a lamp powered by an electric power source 18 to which it is connected by conductive wires penetrating inside the tube by means of insulating wire feedthroughs 19.

According to another embodiment of the process, the light source 12 can be a filament activated by an external high-frequency generator 20. The advantage of this solution is that it avoids a wired connection to an external power supply. In another embodiment of the process, the light source 12, which is located near the G3 electrode, but is not fixed on it, is placed at the end of a removable system such as rails 21 sliding on a guide rod 22 in a lateral appendix 23 of the vacuum enclosure 1. As described above, the light source can be a lamp powered by the electric power supply 18 or a filament activated by the high-frequency generator 20. At the end of the manfacturing process, the light source 12 can be removed from the tube by sliding the rail 21 inside the appendix 23, which is then separated from the vacuum enclosure 1 by melting the junction point by which said appendix is attached to the vacuum enclosure.

The goals mentioned previously can therefore be achieved with the invention process: using an internal light source, the manfacturing of the photocathode can be controlled much more efficiently. The use of the photodiode, which allows the measurement of the transparency of the deposit, also permits a more accurate control of manufacturing operations.

What is claimed is:

1. A manufacturing process of a photocathode for an image intensifier tube, said tube comprising a vacuum enclosure containing the photocathode, an anode and one or several electrodes located between the anode and the photocathode, said process consisting of depositing a photoelectric material on a conductive substrate by vacuum evaporation of said material, and of checking, during the evaporation, the optical transparency of the deposit by illuminating said deposit by means of a light source, said light source being located within the tube and dispersed as to be protected against the vapours of said material.

2. A manufacturing process according to claim 1 wherein the optical transparency of the deposit is measured with an instrument measuring the photoelectric conduction of the deposit, said instrument being electrically connected to the substrate and placed outside the tube.

3. A manufacturing process according to claim 1 wherein the optical transparency of the deposit is measured with a measuring instrument connected to internal photoelectric devices sensitive to the thickness of said deposit.

4. A manufacturing process according to claim 3 wherein said sensitive photoelectric devices are composed of a photodiode located near said substrate beyond an electron path, said photodiode and the substrate being simultaneously coated by said deposit during the vacuum evaporation of said material.

5. A process according to any of the claims 1 to 4 wherein said light source is protected by one of the electrodes.

6. A process according to claim 5 wherein the light source is supported by one of the electrodes beyond a path of any electrons emitted by the photocathode.

7. A process according to claim 5 wherein the light source is connected to an external power source by connecting wires penetrating into the tube by means of insulating wire feedthroughs.

8. A process according to claim 5 wherein the light source is activated by an external high-frequency generator.

9. A process according to claim 5 wherein the light source is removed from the vacuum enclosure at the end of the manufacturing operations.

10. A process according to claim 5 wherein said photoelectric material is an alkaline antimonide.

11. A process according to claim 10 wherein the alkaline antimonide is obtained by evaporation of antimony and of alkaline metals contained in crucibles heated within the vacuum enclosure.

12. A process according to claim 11 wherein the light source is mounted on a removable system so that said light source can be removed from the vacuun enclosure at the end of the manufacturing process.

13. A process according to claim 12 wherein one at least of the crucibles is mounted on a removable system so that said crucible can be removed from the vacuum enclosure at the end of the manufacturing process.

* * * * *